United States Patent [19]

Bardwell

[11] Patent Number: 4,466,498

[45] Date of Patent: Aug. 21, 1984

[54] DETACHABLE SHOE PLATES FOR LARGE DIAMETER DRILL BITS

[76] Inventor: Allen E. Bardwell, P.O. Box 507, High Knob Estates, Front Royal, Va. 22630

[21] Appl. No.: 422,586

[22] Filed: Sep. 24, 1982

[51] Int. Cl.[3] ..... E21B 10/20

[52] U.S. Cl. ..... 175/410; 175/413; 407/46; 408/713

[58] Field of Search ..... 175/410, 409, 412, 413, 175/329, 330; 407/46, 101, 34, 36–39; 408/713, 187, 188

[56] References Cited

U.S. PATENT DOCUMENTS

| | | | |
|---|---|---|---|
| 1,586,415 | 5/1926 | Duda | 175/245 |
| 1,995,043 | 3/1935 | Sanderson | 175/414 |
| 2,022,055 | 11/1935 | Sanderson | 175/414 |
| 2,326,908 | 8/1943 | Williams, Jr. | 175/412 |
| 2,506,341 | 5/1950 | Bullock | 175/413 |
| 3,382,940 | 5/1968 | Stebley | 175/410 |
| 3,536,150 | 10/1970 | Stebley | 175/263 |
| 3,545,554 | 12/1970 | Bardwell | 175/398 |
| 4,083,415 | 4/1978 | Kita et al. | 173/132 |

*Primary Examiner*—James A. Leppink
*Assistant Examiner*—Thuy M. Bui
*Attorney, Agent, or Firm*—Quarles & Brady

[57] ABSTRACT

Shoe members and drill shank members for large diameter cable drilling bits are provided with a tongue on one of the members that projects axially relative to the drill shank member and with an arcuate lip and projecting stop on the other of the members to trap the tongue and prevent radial movement of the shoe member in response to radially directed forces caused by the spinning of the bit in drilling operations. Such forces would impose shear stresses on the fastening members that extend through the shoe member and axially into the drill shank. Four embodiments are disclosed: a spudding bit, two star bits and a scow bit.

10 Claims, 14 Drawing Figures

Fig. 6
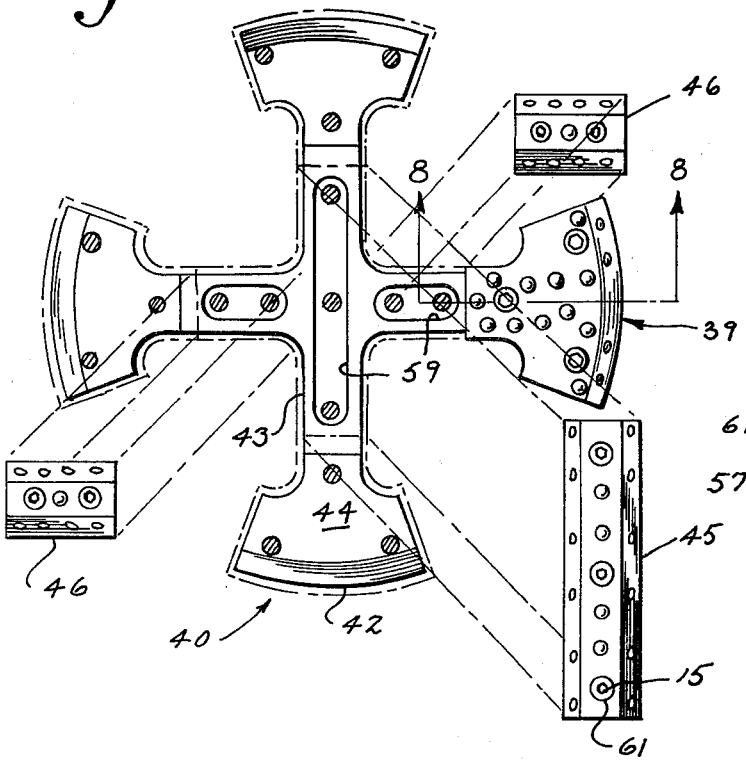
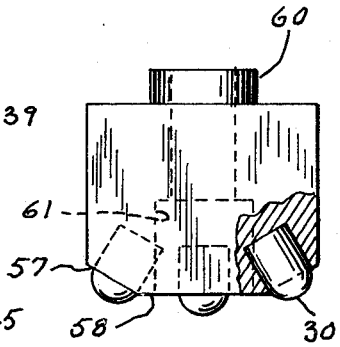
Fig. 7
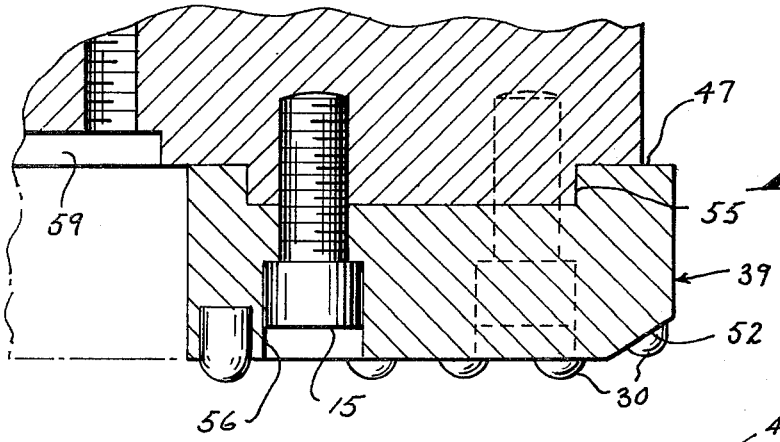
Fig. 8
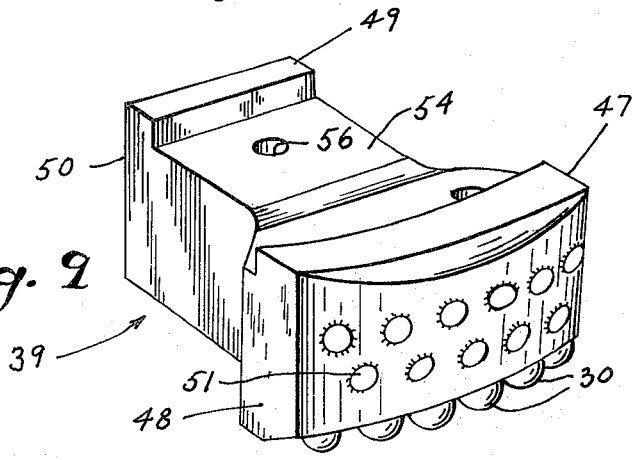
Fig. 9

Fig. 10
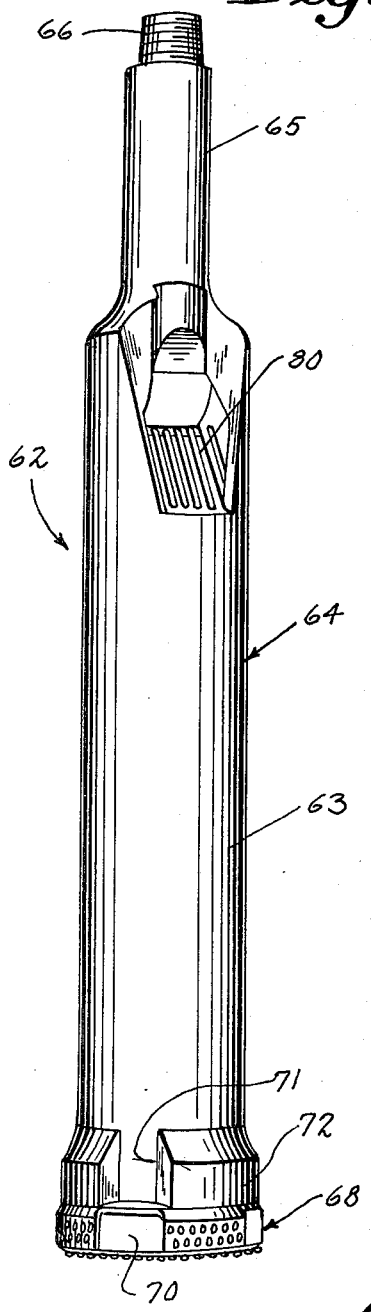
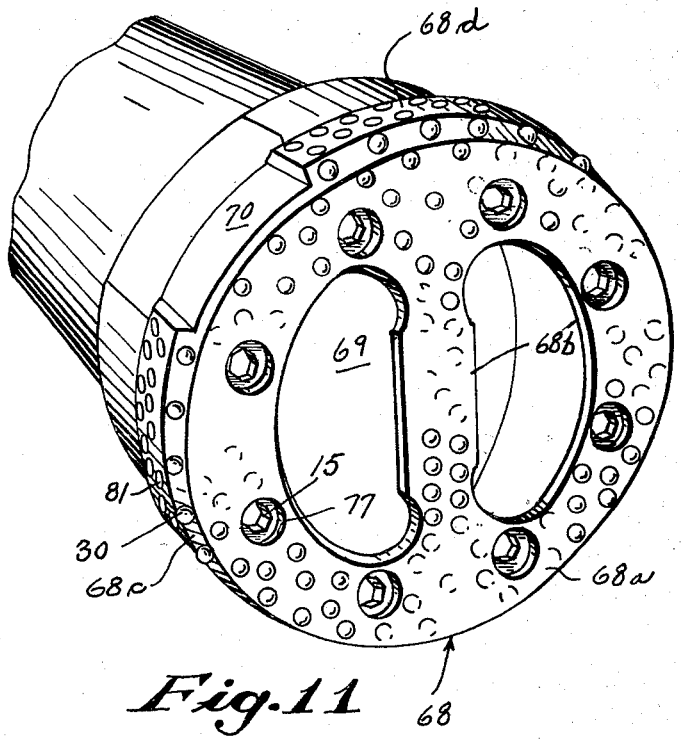
Fig. 11
Fig. 12
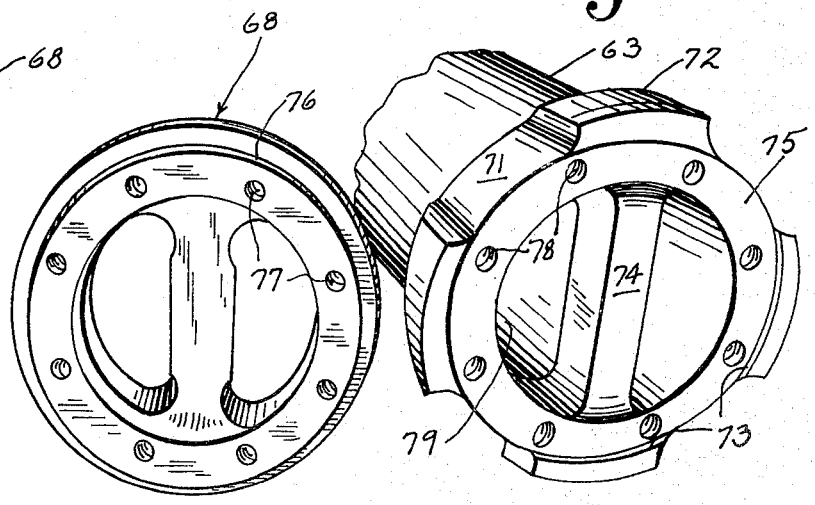

DETACHABLE SHOE PLATES FOR LARGE DIAMETER DRILL BITS

BACKGROUND OF THE INVENTION

1. Field of the Invention

The invention relates to drill bits for gravity-drop cable drilling.

2. Description of the Prior Art

The technique of cable drilling uses a large relatively heavy drill bit that is suspended from a cable drill rig and dropped a distance of twenty-four to thirty-six inches into the bottom of the hole being drilled. The drill bit is dropped at a rate of thirty to sixty times per minute and a spin is imparted to the drill bit as it is dropped to cut a hole of circular cross section with a drill bit of less than circular cross section. Drill bits can be made in an integral construction with hardened cutting edges or blades, but these become dull and worn, and the driller is faced with the repair or replacement of a rather bulky item. Therefore, it has become a practice to mount detachable cutting members on the body of the drill bit.

Cable drilling gets its name from the cable on which the drill bit is suspended from the boom of a cable drilling rig. This type of equipment is more economical for drilling a well hole of relatively large diameter and substantial depth than rotary percussion equipment that is typically used in mining and construction. Such rotary percussion equipment is mounted on over-the-road vehicles, off-the-road vehicles or platforms and uses a string of drill pipes which must reach from the drill rig to the bottom of the hole and which must be driven by motors for both vertical and rotating movement. To drill holes of large diameter would require drill pipes that would be quite large and heavy, whereas in cable tool drilling the drill pipes are replaced by a wire line.

As seen in Sanderson, U.S. Pat. No. 1,995,043 and Sanderson, U.S. Pat. No. 2,022,055 early detachable blades for percussion drill bits were formed as wedge-shapd members with a cutting edge. Two such bits were later employed in cable drilling in a staggered configuration as shown in one of my prior U.S. Pat. No. 3,545,554. A further development in rotary percussion drilling was the provision of pivotable steel plates with tungsten carbide inserts as seen in Stebley, U.S. Pat. No. 3,536,150. These inserts are much harder and more durable than the steel plates in which they are embedded and provide greater efficiency in cutting through hard earth formations. In Stebley, the rotary percussion drill bit is reciprocated a distance of only three to five inches at a rate of 500–800 impacts per minute. The bit is rotated at 20 revolutions per minute or no more than 9 degrees per impact.

Cable drills, on the other hand, are provided with a means for winding up the cable during the lifting stroke and for imparting a spinning action to the drill bit as it travels through the downstroke to the bottom of the hole. This provides shear stresses of a magnitude unique to cable drilling against elongated axial fasteners that are used to attach metal plates to the bottom of the drill bit. The primary cutting members in Stebley are made pivotable and do not employ axial fastening members. Fixed drill plates with tungsten carbide inserts have not been known in larger sizes for cable drilling because a workable configuration for use of such plates with the bits commonly used in cable drilling operations has not been known. These commonly used bits include two-winged spudding bits, four-winged star bits and hollow scow bits.

The scow bit is a specialized bit with a hollow barrel section in which water and cuttings that have been mixed into a slurry in the bottom of a hole can be evacuated. This is accomplished by the bailing action of a valve within the barrel section that is forced open on the downstroke and pulled closed on the upstroke to trap a portion of the slurry. Kita et al., U.S. Pat. No. 4,083,415 shows a mining bit with a central opening like a scow bit, however, the Kita drill bit is rotated in small increments while in contact with the work, which is a different type of drilling action than found in cable drilling. Also in Kita, the detachable portion of the bit is formed in the shape of a cup which fits over one end of the drill bit shank and is held in place by balls that are received in a groove around the outside of that shank. Kita does not address the problem of forces on axial fasteners for plates used in the cable drilling environment.

SUMMARY OF THE INVENTION

The invention resides in a drill bit for gravity-drop cable drilling in which one or more detachable shoe members with hardenable inserts are removably attached by axially extending fasteners to a bottom diametrical portion of a shank member to form the drill bit. One of these members has a radially extending tongue that projects axially relative to the shank member and is received in a depression in between an arcuate lip and a stop formed on the other member. In one embodiment this stop takes the form of a second arcuate lip. This combination restrains the shoe plate member from movement in the radial direction where the greatest shear forces are experienced.

The invention further resides in various embodiments of the shoe members adapted for use in such drill bits as a spudding drill shoe member, a star drill shoe member and a scow drill shoe member.

A further aspect of the invention in the shoe member is the provision of means restraining the member from rotational movement due to torsional forces.

A further aspect of the invention is the provision of cutter blades for large diameter drill bits that can be attached to the bottom of the drill bit shank and located between the shoe members to cut the center of the hole being drilled. These can be mounted to the inside of the shoe plate or formed integrally in a scow shoe and positioned to cover a diametrical support.

One general object of the invention is to provide an economical, replaceable carbide-studded shoe member for cable drilling of large diameter holes. Large diameter in this instance refers to holes twelve inches in diameter or larger.

Another general object of the invention is to provide a cable drilling tool for faster drilling of wells and elevator shafts. The drill plates of the present invention have been shown to be especially effective in drilling through lava rock formations.

Another object of the invention is to permit the retrofitting of large diameter steel bit bodies with highly efficient carbide-tipped drill bits.

Another object of the invention is to provide shoe members which are easily removable and attached by use of conventional fasteners such as socket-head cap screws.

Still another object of the invention is to provide a drill bit for drilling large diameter holes with drilling machines of limited weight capacity in which spudding bits and star bits of non-circular cross section can be used to drill holes of circular cross section and maximum diameter.

The foregoing and other objects and advantages of the invention will appear in the following description, wherein reference is made to the accompanying drawings that form a part hereof, and in which there is shown by way of illustration three preferred embodiments of the invention. These embodiments, however, do not necessarily represent the full scope of the invention, but are merely illustrative, and therefore reference is made to the claims at the end of the description for determining the scope of the invention.

BRIEF DESCRIPTION OF THE DRAWINGS

FIG. 6 is an exploded bottom view of a second embodiment of a drill bit incorporating the present invention;

FIG. 7 is an end view of one of the elongated cutter plates that was exploded from the bottom of the drill bit in FIG. 6;

FIG. 8 is a fragmentary sectional view taken in the plane indicated by line 8—8 in FIG. 6;

FIG. 9 is a perspective view of one of the shoe plates seen in FIG. 6;

FIG. 10 is an elevation view of a third, scow drill embodiment that incorporates the present invention;

FIG. 11 is a perspective view from the bottom end of the drill bit of FIG. 10;

FIG. 12 is a perspective view of the mating portions of the shank and shoe plates of FIGS. 10 and 11;

DETAILED DESCRIPTION OF THE PREFERRED EMBODIMENT

Figure 1:
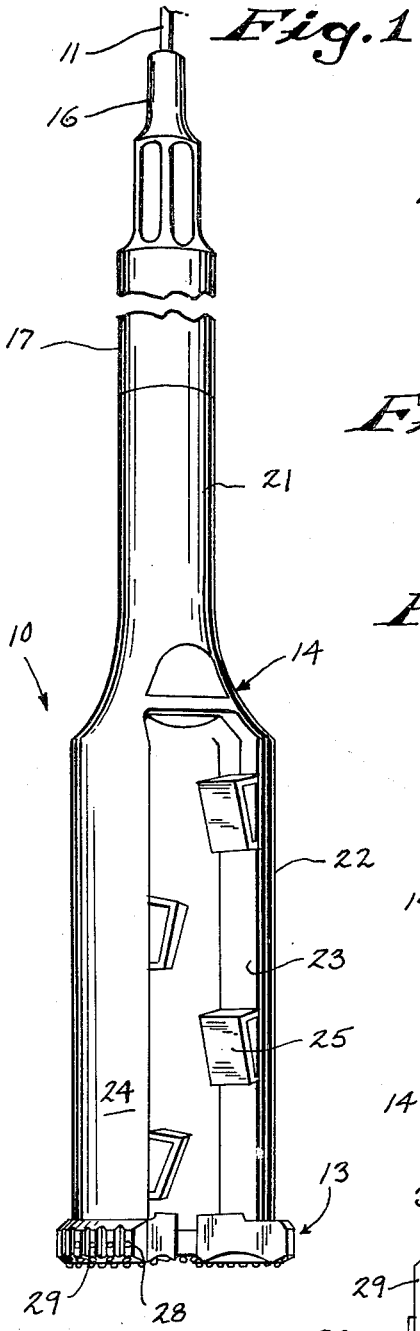
FIG. 1 is an elevation view of a first embodiment of a drill bit of the present invention that is suspended from a cable drilling rig.
Figure 2:
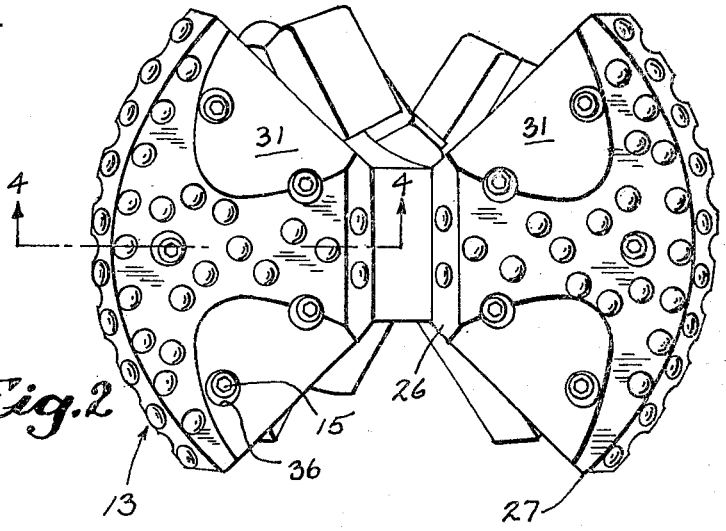
FIG. 2 is a bottom view of the drill bit of FIG. 1.
Figure 3:
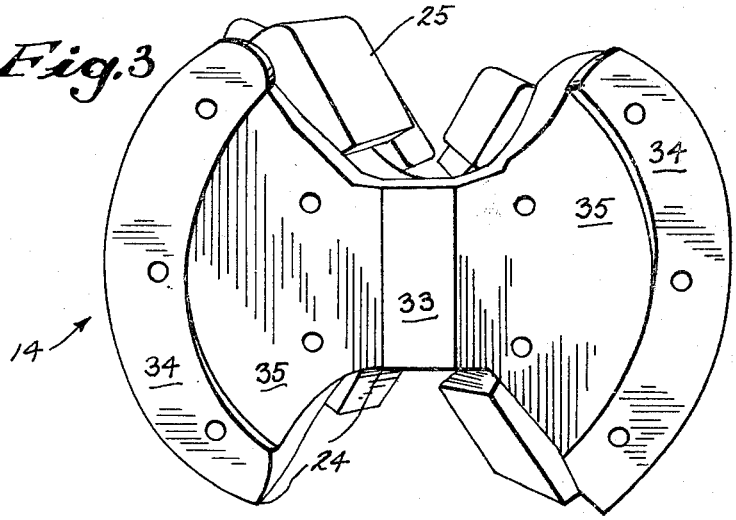
FIG. 3 is a bottom view of a shank of the drill bit of FIG. 2 with the shoe plates removed.

A first embodiment of the invention is seen in FIG. 1, where a spudding drill bit 10 is suspended by a woven, steel cable 11 from the boom of a cable drilling rig (not shown). The spudding bit 10 includes detachable shoe plates 13 which are fastened to the bottom of a drill bit shank 14 with socket-head cap screws 15 seen in FIGS. 2 and 4. As seen best in FIG. 4, these screws 15 are inserted upward through the plates 13 into tapped holes in the drill shank 14 which are parallel to its longitudinal axis. The heads of the screws 15 are received to some depth within the counterbores of holes 36 in the plates 13. In this instance there are five such holes 36 in each plate as seen in FIGS. 2 and 3.

The drill bit 10 is coupled to the cable 11 by a wire rope socket 16. FIG. 1 shows the lower end 17 of a drill body with an internal hammer as shown and described in my prior U.S. Pat. No. 4,440,245, issued Apr. 3, 1984. The drill body is connected between the rope socket 16 and a threaded tip (not seen in FIG. 1) of the drill shank 14 and adds a chattering effect to each blow or drop of the drill bit 10.

The drill bit 10 is used to drill well holes and elevator shafts by dropping it a distance which is typically twenty-four to thirty-six inches, at a rate which is typically thirty to sixty times per minute. As the steel cable 11 is lifted on the upward stroke of the drill cycle, the rig causes the cable to be wound or twisted in the clockwise direction (as viewed in FIGS. 2 and 3). When the drill bit 10 is dropped it spins counterclockwise. This spinning action causes the right-hand threaded connection to the drill body and the right-hand threaded screws 15 to tighten and allows the spudding bit 10, which is of non-circular cross section, to cut a hole of circular cross section.

The shank 14 of the spudding 10 is elongated with a cylindrical stem 21 and a body 22 of larger diameter than the stem 21, but of non-circular cross section. The body 22 has two large axially extending and oppositely facing concavities 23 which are positioned at right angles to a pair of cutter wings 24 extending in opposite radial directions. The concavities 23 provide a drill shank 14 of less mass for a given diameter and of non-cylindrical shape which overcomes the problem of suction that would otherwise occur when the bit 10 was in a hole. Some lifting fins 25 are welded to the sides of the drill shank 14 within these concavities 23 to dislodge and carry upward loose pieces of the earth formation being drilled.

Referring now to FIG. 2, the shoe plates 13 are fan-shaped members that extend radially outward from a straight, inwardly facing side along its heel 26 to an arcuate, outwardly facing side along its toe 27. The heel 26 and toe 27 are formed with oblique surfaces on their bottom peripheral edges. The body of each shoe plate 13 is preferably made of steel. Spherical-headed stud inserts 30 of material that is harder than steel to provide longer wear, such as alloys of tungsten carbide, are press and/or shrink fitted into bores in the body of each shoe plate 13. The inserts 30 are distributed in patterns along the flat bottom surfaces of the shoe plates 13 and are also angularly positioned thirty-five degrees from vertical to project from the oblique surfaces along the heel 26 and toe 27 of the body of each shoe plate 13. Each of the plates 13 also contains a pair of downwardly facing concave portions 31 along opposite radial sides in which no inserts are positioned. The outwardly facing peripheral surface of the toe 27 has flat-headed inserts 28 and vertical grooves 29 to reduce wear on this surface. The heel 26 of each shoe plate 13 abuts a rectangular, depending stop 33 that extends along the heels 26 of the shoe plates 13.

Figure 4:
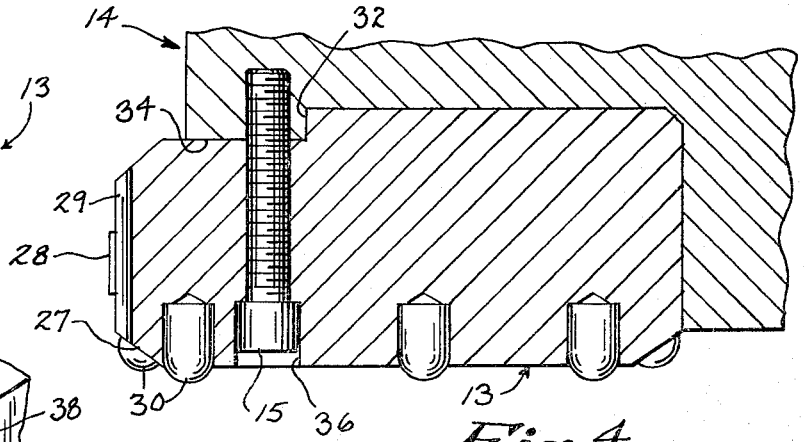
FIG. 4 is a fragmentary sectional view taken in the plane indicated by line 4—4 in FIG. 2.

As seen in FIG. 3 with the shoe plates 13 removed, a conventional spudding bit has been converted to a shank 14 for the present bit by forming arcuate depending lips 34 on the outer peripheral edges of the cutter wings 24. A pair of fan-shaped recesses are defined by the lips 34, the central stop 33 and two fan-shaped surfaces which shall be referred to as palates 35. Fan-shaped tongues 32 are formed by raised portions of the shoe plates 13 as seen in FIG. 4 and these tongues 32 are received against the palates 35 on the bottom of the drill shank 14 to secure the shoe plates 13 against movement either inwardly or outwardly in the radial direction.

Figure 5:
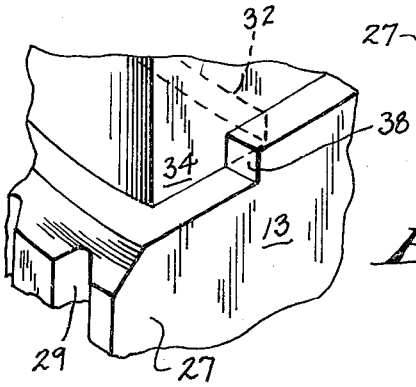
FIG. 5 is a detail view of an area where the shoe plates are mounted on the shank of the drill bit seen in FIG. 1.

Although the invention is particularly aimed at preventing the movement of the plates 13 in a radial direction, one further aspect concerns securing the plates 13 against torsional forces that would be directed normal to the radial forces. As seen in FIG. 5 finger-like projections 38 extend forward from the tongue 32 on each shoe plate 13 to catch the adjacent lower side portions of the shank 14 and prevent rotation of the plates 13 relative to the shank 14.

A second embodiment of the invention is seen in FIGS. 6–9 in which four identical shoe plates 39 (one of which is shown in full) are fastened to the bottom of the star drill bit that forms a drill shank 40 for the present invention. The shank 40 is similar to that seen in FIG. 1 in having a stem, however, the body of the shank 40 is formed with four cutter wings 42 instead of two. These cutter wings 42 are each formed symmetrically along one of two orthogonal, transverse axes so that the cutter wings 42 are angularly spaced at ninety degree intervals. Each cutter wing 42 has a radially extending web 43 and a wider arcuate section 44 at its radial extremity. Each of the four shoe plates 39 covers a portion of the bottom of the web 43 as well as covering the arcuate section 44 at its radial extremity. This leaves a cross-shaped portion of the shank bottom to be covered by an elongated central cutter plate 45 and two shorter wing cutter plates 46. With the larger shoe plates 39 spaced apart by about seven inches in a twenty-two inch to thirty inch diameter drill bit, the smaller cutter blades 45 and 46 provide for the effective drilling of the center portion of the hole.

As seen in FIG. 9, the body of each shoe plate 39 has an arcuate lip 47 along the upper front edge of its toe 48 and a straight abutment 49 along the upper front edge of its heel 50. The toe 48 has flat-headed inserts 51 of hardened metal projecting a short distance from its outer peripheral face. An oblique surface 52 is provided around the lower front edge of the toe 48 so that spherical headed inserts 30 of carbide metal can project at an angle thirty-five degrees from vertical as described for the first embodiment. The front of the heel abutment 49, the back of the lip 47 and a palate surface 54 define a recess in the top of the shoe plate 39 which receives a tongue 55 of corresponding shape that depends from the bottom of the corresponding cutter wing 42. The shoe plates 39 are fitted over these tongues 55 and are secured to the bottom of the shank by socket-head cap screws 15 seen in FIGS. 6 and 8 which extend upwardly into counterbored and tapped holes 56 parallel to the axis of the drill shank 40. When the shoe plates 39 are mounted on the bottom of the shank 40, they are restrained against outwardly directed radial movement by the heel abutment 49 and are further restrained against inwardly directed radial movement by the lip 47. From the first two examples of the invention it will be seen that the tongue can be formed on either a drill shank or a shoe plate and the lip and cooperating stop can be formed on the other of these members.

The smaller cutter blades 45 and 46 are formed in a generally rectangular box shape except for oblique surfaces 57 extending along the sides of the bottom surface 58. Spherical-headed stud inserts 30 of carbide metal project from these surfaces 57 at an angle of 35 degrees from vertical. Some of these stud inserts 30 also depend vertically downward from the flat bottom surface 58. The bottom of the shank 40 has elongated milled grooves 59 disposed in the pattern of a cross to receive mating projections 60 on the cutter blades 45 and 46. The central cutter blade 45 extends across the center of the shank 40 from one large shoe plate 39 to an opposite shoe plate 39, and two wing cutter blades 46 fill the spaces 39 between the center cutter blade 45 and the two shoe plates 39 spaced on opposite sides of the center cutter plate 45. The cutter blades 45 and 46 are attached with bolts 15 which extend through counterbored holes 61 similar to the attachment of the shoe plates 39.

A third embodiment of the invention is a scow drill bit 62 that is seen in FIGS. 10–12. The scow bit is a specialized bit in which the body 63 of the drill shank 64 is formed as a hollow barrel in which water and cuttings that have been mixed into a slurry in the bottom of a hole can be evacuated. If enough of this slurry accumulates it may exit the drill stem through the grate 80 in FIG. 10. The upper portion of the shank 64 is formed with a cylindrical stem 65 and a threaded upper tip 66 that can be received in a drill body as described for the embodiment in FIG. 1. The scow bit 62 has a plate valve (not shown) within the body 63 that is forced open on the downstroke of the drill bit 62 and pulled closed on the upstroke to trap a portion of the slurry.

As seen in FIG. 11, a single shoe plate 68 with two kidney-shaped openings 69 is preferred for the scow bit 62. The body of the shoe plate 68 has an annular outer portion **68*a* and a diametrical center portion 68*b* that is formed integrally with the annular outer portion 68*a*. Spherical-headed inserts 30 of carbide metal are mounted to project downward from the bottom of both portions and an oblique surface 68*c* is formed around the circumference of the annular portion 68*a* to carry inserts 30 that project at an angle from vertical to cut the sides of the hole. Flat-headed inserts 81 are mounted to project radially from the outer periphral surface of the cylindrical shoe plate 68. It is preferred, but not required, that several indentations 70 be provided around the outer peripheral surface of the shoe plate 68 to overcome the effects of suction in the bottom of the hole. These indentations may be aligned with channels 71 in a reinforced portion 72 of slightly greater diameter than the main portion of the body 63 as seen in FIG. 10. This reinforced portion 72 carries four depending arcuate lips 73 on its lower end which are separated by the channels 71 as seen best in FIG. 12**.

The lower end of the drill shank body 63 also has a bottom diametrical portion which includes a support bar 74 across the entrance into its hollow body portion. This support bar 74 extends downwardly, as do the arcuate lips 73, beyond an annular recessed surface 75 around the bottom of the drill shank body 63. The annular shoe plate 68 has a ring-shaped projection 76 that is received in the annular recess 75. The shoe plate 68 has counterbored holes 77 through its ring-shaped projection 76 which are spaced around it at regular angular intervals. A corresponding set of tapped holes 78 is provided in the recessed surface 75 so that socket-head cap screws 15 can be used to fasten the shoe plate 68 to the body as seen in FIG. 11. When the shoe plate 68 is mounted on the drill shank 63 the support bar 74 provides backup support for the diametrical center portion of the shoe plate 78. Analogous to the other embodiments, the shoe plate 68 will be restrained against inward radial movement by the projecting diametrical support 74 and against outward radial movement by abutment with the arcuate lips 73. This reduces the shear forces that would otherwise be exerted on the cap screws 15.

Figure 13:
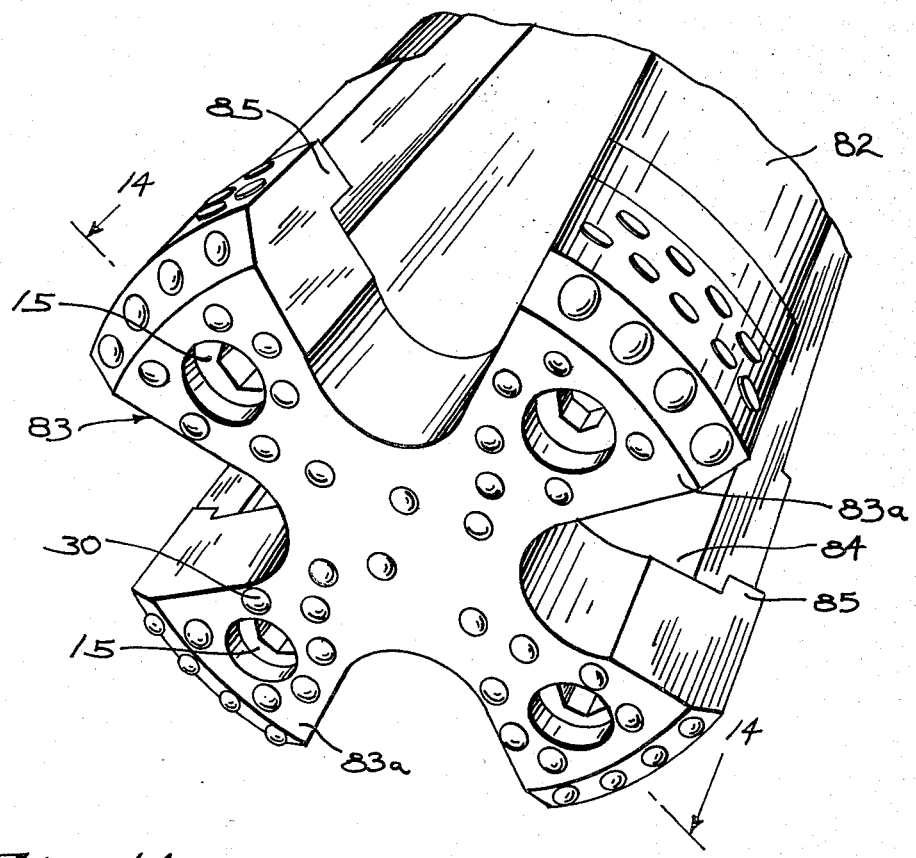
FIG. 13 is a perspective view of a fourth embodiment of the invention in which a single shoe plate is detachably mounted in a start drill bit.
Figure 14:
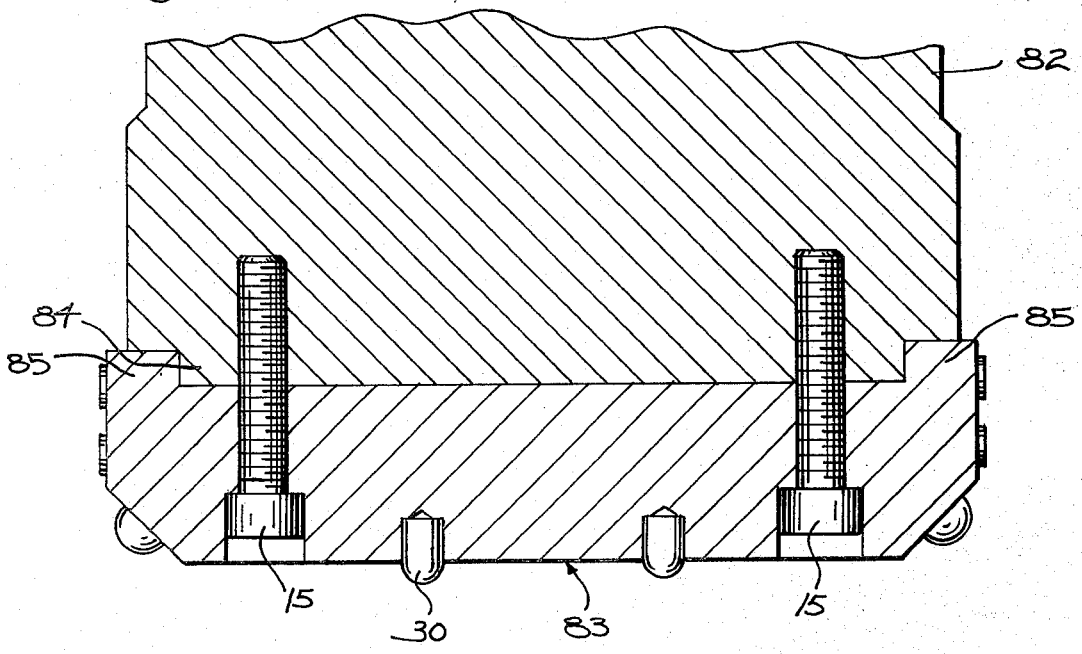
FIG. 14 is a sectional view taken in the plane indicated by line 14—14 in FIG. 13.

A fourth embodiment of the invention is seen in FIGS. 13 and 14, where a star drill shank 82 has a single, four-winged, carbide-studded shoe plate 83 detachably mounted by socket-head screws 15. Such an arrangement is used for drilling smaller holes than the structure seen in FIGS. 6–9. Because a single plate 83 is used, separate cutter blades and additional abutments are not seen at the bottom center of the drill shank 82.

As illustrated by FIG. 14, a star-shaped tongue 84 is formed on the bottom end of the drill shank 82 and four projecting arcuate lips 85 are formed on the upper front edges of the toes of the four respective blade portions 83*a* of the shoe plate 83. Since the arcuate lips 85 are disposed to abut oppositely facing sides of the tongue 84 they restrict the plate 83 from movement in either direction along a diameter of the shoe plate 83. It can be seen from this embodiment how a second arcuate lip 85 opposite a first lip 85 performs the function of the central abutment in other embodiments. The central abutments are nevertheless important additions to bits with multiple shoe plates.

With this description of several illustrations of the invention, it should be apparent to those skilled in the art that other embodiments are possible without departing from the principles of the invention. Therefore, the following claims are provided to define the scope of what I regard as my invention.

I claim:

1. An improved drill bit for gravity-drop cable drilling, the bit comprising:

an elongated shank member having a bottom diametrical portion;

a shoe member with a metal shoe body and with inserts of a metal that is harder than the metal of the shoe body, some of the inserts projecting at an angle from a bottom of a toe on the shoe body, these angularly projecting inserts being operable to cut along an outer edge of a hole being drilled;

fastener means extending through the shoe member and into the shank member in an axial direction relative to the shank member for removably coupling the shoe member in a fixed position along the bottom diametrical portion of the shank member;

wherein one of the members coupled together by the fastener means has a tongue projecting axially relative to the shank member and disposed longitudinally relative to the bottom diametrical portion of the shank member; and wherein the other of the members coupled together by the fastener means has an arcuate lip that opposes a radially outward facing side of the tongue and also has a projecting stop that opposes a radially inward facing side of the tongue to cooperate with the lip in restraining radial movement of the shoe member along the bottom diametrical portion of the shank member in response to radial shear forces encountered during cable drilling operations.

2. The improved drill bit of claim 1, wherein the lip and projecting stop are formed on the bottom diametrical portion of the shank member and wherein the tongue is formed on the shoe member.

3. The improved drill bit of claim 2, wherein: the shank member has openings on opposite sides of the bottom diametrical portion into a hollow portion;

wherein the lip is divided into four angularly spaced apart arcuate sections;

wherein the tongue is annular in shape and is received against the bottom diametrical portion of the shank member between opposing arcuate sections;

wherein the bottom diametrical portion provides a projecting support; and wherein the shoe member has a cutter blade portion extending across the projecting support.

4. The improved drill bit of claim 2, wherein:

the bottom diametrical portion of the shank member has two cutter wings extending in opposite radial directions;

further comprising a second shoe member; and wherein the first-mentioned shoe member and the second shoe member each have an axially projecting tongue that is received and positioned between a projecting stop and a lip on a corresponding cutter wing.

5. The improved drill bit of claim 1, wherein the lip and projecting stop are formed on the shoe member and wherein the tongue is formed on the bottom diametrical portion of the shank member.

6. The improved drill bit of claim 5, wherein:

the shank member has a second bottom diametrical portion crossing the first-mentioned bottom diametrical portion, the bottom diametrical portions forming four radially extending cutter wings;

further comprising three shoe members in addition to the first-mentioned shoe member, each of the four shoe members having a lip and a projecting stop; and wherein each cutter wing has a radially directed tongue that is received in position between the lip and the projecting stop of a respective shoe member.

7. The improved drill bit of claim 1, wherein:

the shank member has a second bottom diametrical portion crossing the first-mentioned bottom diametrical portion to form four radially extending cutter wings;

further comprising three shoe members in addition to the first-mentioned shoe member;

wherein each shoe member is mounted at a radial extremity of a respective one of the four cutter wings to provide a cross-shaped gap in between the cutter wings; and wherein cutter blade means with carbide metal inserts spans the cross-shaped gap to cut the center portion of the hole being drilled.

8. The improved drill bit of claim 1, further comprising a second shoe member;

wherein the shoe members have respective heels which are spaced apart to provide a gap, the shoe members extending from their respective heels in opposite radial directions along the bottom diametrical portion of the shank member; and wherein a central cutter blade with projecting hardened metal inserts is mounted to the bottom of the shank member in the gap to cut the center portion of the hole being drilled.

9. The improved drill bit of claim 1, further comprising means formed along the radially extending sides of the shoe member and along adjacent sides of the shank member to restrain the shoe member against rotation in response to torsional forces.

10. The improved drill bit of claim 1, wherein the first-mentioned lip is disposed at one end of the bottom diametrical portion of the shank member; and wherein the projecting stop is a second arcuate lip disposed at an opposite end of the bottom diametrical portion of the shank member.

* * * * *